United States Patent [19]

George

[11] 3,949,426

[45] Apr. 13, 1976

[54] CONFORMING LADIES GARMENTS HAVING SMOOTH LINES

[76] Inventor: Georgia A. George, 404 E. 55th St., New York, N.Y. 10022

[22] Filed: July 23, 1974

[21] Appl. No.: 491,120

[52] U.S. Cl. ..... 2/73; 2/243 B

[51] Int. Cl.[2] ..... A41B 9/16

[58] Field of Search ..... 2/73, 74, 75, 211, 109, 2/113, 243 B

[56] References Cited

UNITED STATES PATENTS

| | | | |
|---|---|---|---|
| 2,427,041 | 9/1947 | Bishop | 2/73 |
| 2,429,188 | 10/1947 | Lehman | 2/74 |
| 2,931,044 | 4/1960 | Rosenberg | 2/73 |
| 3,258,780 | 7/1966 | Vitolo | 2/74 |
| 3,261,024 | 7/1966 | Delaney | 2/74 |
| 3,745,587 | 7/1973 | Bradley | 2/74 X |

*Primary Examiner*—H. Hampton Hunter
*Attorney, Agent, or Firm*—Seymour Manello

[57] ABSTRACT

Conforming ladies garments having smooth lines assembled from one piece of woven or knit material comprising a tubular body member providing at one end a torso opening and at the other a head opening divided by two shoulder straps positioned so as to provide a neck opening and two arm openings; cut and assembled so that the bias of said piece of fabric is substantially parallel to the axis of symmetry of the body of the wearer.

7 Claims, 11 Drawing Figures

FIG. 1
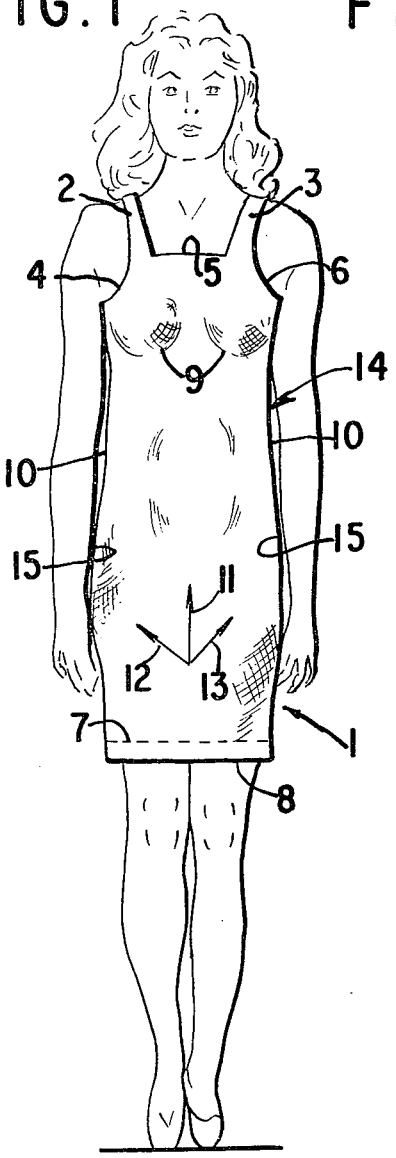
FIG. 2
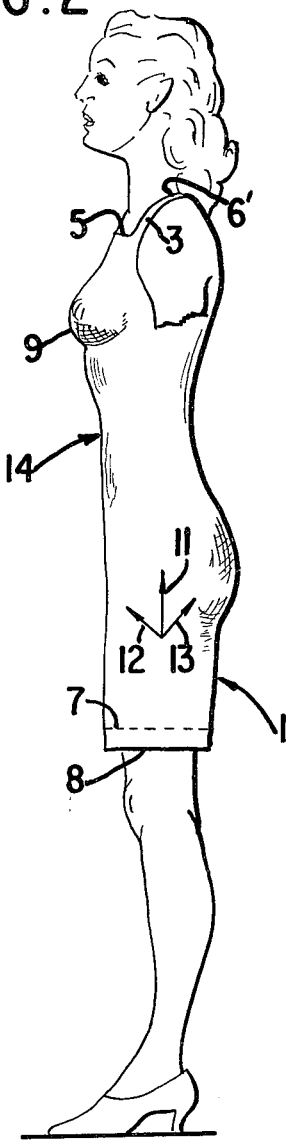
FIG. 3
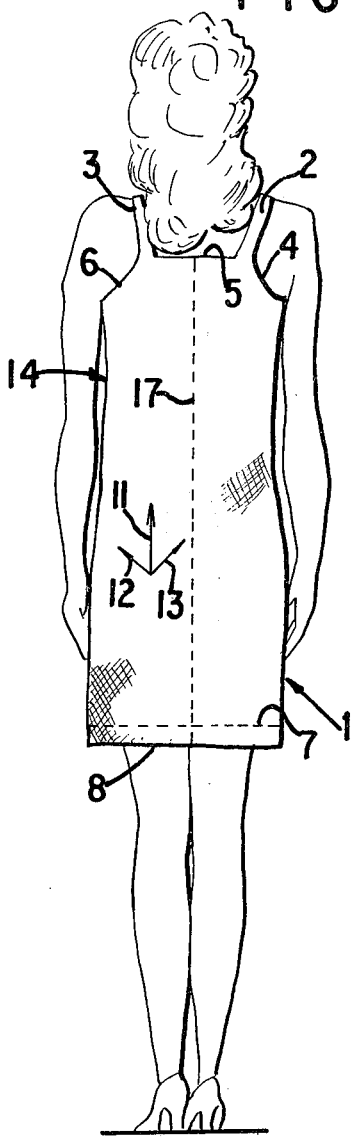
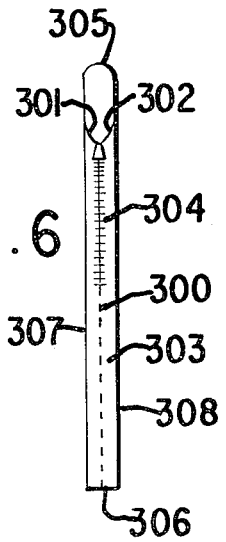
FIG. 6
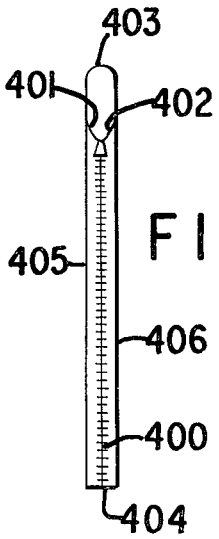
FIG. 7

CONFORMING LADIES GARMENTS HAVING SMOOTH LINES

The instant invention related, in general, to torso conforming ladies garments. In particular, this invention concerns a torso conforming ladies garment having smooth lines which comprise a single piece of woven or knit fabric adopted to substantially conform to the shape of the feminine body from the area of the hips to the axilla when it is worn around the feminine body, said garment being constructed so that the bias of said single piece of fabric is substantially parallel to the axis of symmetry of said feminine body, said garment being cut so that it defines shoulder suspending means, said garment having three assembly seams, the first being located on the torso portion of the garment parallel to the axis of symmetry of said feminine body, the second and third seams being located so that said shoulder suspending means are fastened together to form shoulder straps. The garment may be adopted to be worn as a ladies undergarment such as a slip or the like, as ladies sleepwear such as a nightgown or the like or as ladies outerwear such as a housecoat, loungewear, a blouse, a coat, or dress or the like. When the garment is adopted to be worn as a slip, the seam will normally be located, approximately centered, on the rear torso portion of the garment parallel to the axis of symmetry of said feminine body. The length of the garment is not critical and the garments may be constructed short as for a short slip or coat or long as for a lounging coat or evening dress. The length of the garment is dictated only by the type of garment desired and the fashion length in vogue at that time. The garments may be constructed with various types of sleeves or necklines to reflect the intended use and appearance of the article provided they do not detract from the smooth line and conforming features of the garments. Furthermore, ornamentation may be attached to the garments if the desired effect is maintained. A facing may be used if desired.

BACKGROUND OF THE INVENTION

The desirability of conforming ladies garments having smooth lines of the general type discussed herein is well documented in the prior art. However, these previous efforts have not achieved the smooth lined conforming garments of the herein disclosed invention. Exemplary of the use of knitted fabrics are U.S. Pat. No. 672,028, U.S. Pat. No. 3,488,776 and U.S. Pat. No. 3,736,596. Other attempts to provide a conforming or smooth lined garments did not accomplish this purpose. For example, U.S. Pat. No. 2,632,892 provides a garment which is of pleasing appearance yet is not of the conforming nature of the instant described garments. Further, U.S. Pat. No. 3,012,249 which disclosed a draped garment having smooth lined is not capable of providing the smooth lined conforming garments of the instant invention. Similarly, U.S. Pat. No. 3,473,167 described a smooth lined garment which lacks the conforming features of the instant invention.

The instant invention is further advantageous in that it permits a garment to be assembled from a single piece of material cut on the bias. This garment which, when assembled, has only one seam on the tubular body member and is particularly advantageous as it provides a very desirable easily assembled garment with a minimum opportunity to break the smooth lines. Although garments provided from a single piece of material are known, for example, see U.S. Pat. No. 3,736,596, none provides a smooth lined conforming ladies garments of the present invention. The use of more than one piece of material to construct a garment of this type provides a less conforming less smooth lined garment.

OBJECTS OF THE INVENTION

It is an object of this invention to provide a ladies garment which, when worn, provides a smooth lined conforming appearance generally flattering the wearer.

It is a further object to provide a garment which may be formed with less cutting than the usual garment and which provides for a minimum occurrence of wrinkling and seam construction to show through and disrupt the lines of the garment.

It is another object of this invention to provide a one piece garment conforming to the contour of the torso of the wearer and enhancing the pleasing natural lines.

It is yet another object of this invention to provide a one piece garment complemented by a one piece facing.

It is still another object of this invention to provide garments of a general smooth lined nature from woven to knit fabrics which are adapted to various uses through the adoption of various garment lengths, sleeve and neck opening styles.

DESCRIPTION

FIG. 1 is a front view of the garment worn as a ladies slip.

FIG. 2 is a side view of the garment worn as a ladies slip.

FIG. 3 is a rear view of the garment worn as a ladies slip.

FIG. 6 is a front view of a tubular body member seam which may be partially opened and reclosed.

FIG. 7 is a front view of a tubular body member seam which may be completely opened and reclosed.

Figure 4:
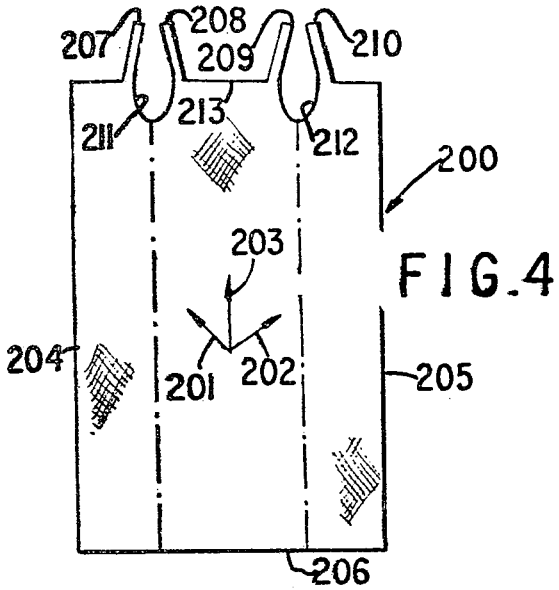
FIG. 4 is a front view of the garment, before assembly, as it appears after cutting from the single piece of material.

Referring to FIG. 1, the assembled one piece garment 1 is cut on the bias. Arrows 12 and 13, respectively, define the direction of the warp and woof of the fabric in the case of woven fabrics and the course and wale in the case of knit fabrics and arrow 11 indicates the direction of the bias of the fabric. The tubular body member 14 has at one end a torso opening defined by edge 8 which has a finished hem 7 and the other end a head opening which is divided by two shoulder suspending means or straps 2, 3 into a neck opening defined by edge 5 and two arm openings defined by edges 4 and 6. The conforming feature of the garment is demonstrated by the readily discernible anatomical features, breasts 9, waist 10 and hips 15. The various edges may be finished by conventional means such as hemming, overcasting or adding trim.

Referring to FIG. 2, the assembled one piece garment 1 is cut on the bias. Arrow 11 defines the direction of the fabric. The tubular body member 14 has at one end a torso opening defined by edge 8 which is finished with a hem 7 and at the other end a neck opening defined by edge 5 which is separated from the arm opening defined by edge 6 by shoulder suspending mean 3 which is assembled by seam 6'.

Referring to FIG. 3, the assembled one piece garment 1 is cut on the bias, which is in the direction of arrow 11. The tubular body member 14 has at one end a torso opening defined by edge 8 which is finished with a hem 7 and at the other end a neck opening defined by edge 5 which is separated from the arm openings defined by edges 4 and 6 by shoulder suspending means 2 and 3. The tubular body member is assembled by fully sewn seam 17 which also may be partially sewn with a means for opening and reclosing a portion of the seam or may be provided with means to open and reclose the entire seam. The means used to open and reclose the seam are exemplified by zippers, buttons, snaps and the like.

Referring to FIG. 4, the unassembled one piece garment 200 is cut on the bias and is substantially rectangular in shape including on one shorter side four substantially equal projections extending beyond the boundary line of the substantially rectangular shape, said projections are grouped into two pairs, each pair of which contains between them an indentation cut into the piece of fabric beyond the boundary line line of the substantially rectangular shape; said piece of fabric adopted to be assembled into a tubular torso conforming ladies slip undergarment which substantially conforms to the shape of the feminine body from the area of the hips to the axilla when it is worn around the feminine body, said garment being constructed so that the bias of said single piece of fabric is substantially parallel to the axis of symmetry of said feminine body, said garment having shoulder suspending means, said garment having three assembly seams, the first being located on the torso portion of the garment parallel to the axis of symmetry of said feminine body, approximately centered on the rear torso portion of the garment, the second and third seams being located so that said shoulder suspending means are fastened together to form shoulder straps. Arrows 201 and 202 represents the direction of the warp and woof of woven fabric, respectively, while arrow 203 represents the direction of the bias of the fabric. Edges 204 and 205 are joined at the body seam to form the tubular body member. When assembled edge 206 will define the torso opening and may be hemmed. For assembly edge 207 is joined to edge 208 and edge 209 is joined to edge 210 to form the two shoulder suspending means. After assembly edges 211 will define one arm opening and edge 212 the other. Edge 213 will define the neck opening.

Figure 5:
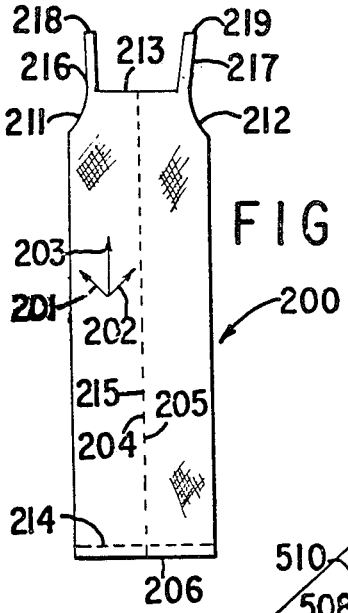
FIG. 5 is a rear view of the garment after assembly.

Referring to FIG. 5, the assembled garment 200 is cut on the bias represented by arrow 203. Arrows 201 and 202 represent the direction of the warp and woof of the fabric, respectively. The torso opening is defined by edge 206 which is finished with a hem 214. Seam 215 is formed by joining edges 204 and 205 of the single piece of fabric. Edges 211 and 212 define the arm openings and edge 213 defines the neck opening. The shoulder suspending means 216 and 217 are formed by joining appropriate parts of the single piece of fabric in seams 218 and 219. Edges 211, 212 and 213 may optionally be finished with a hem for comfort or appearance by providing extra material when cutting the single piece of fabric.

Referring to FIG. 6, seam 300 is formed by joining together edges 301 and 302. Portion 303 of seam 300 is sewn and portion 304 of seam 300 is joined by means which may be opened and reclosed such as a zipper, snaps, buttons or the like. This arrangement of seam 300 wherein it may be partially opened provides for a garment which may be easily donned as a pullover garment by opening portion 304 of seam 300 for dressing purposes and reclosing after dressing for appearance purposes. Edge 305 is at the head opening and edge 306 is the bottom or torso opening of the garment. Edges 307 and 308 are part of the tubular body member.

Referring to FIG. 7, seam 400 is formed by joining together edges 401 and 402 by means which may be opened and reclosed such as a zipper, snaps, buttons or the like. This arrangement of seam 400 wherein it may be completely opened and reclosed provides a garment which is donned like a coat without pulling over the head. Edge 403 is the head opening of the garment and edge 404 is the bottom or torso opening of the garment. Edges 405 and 406 are part of the tubular body member.

Figure 8:
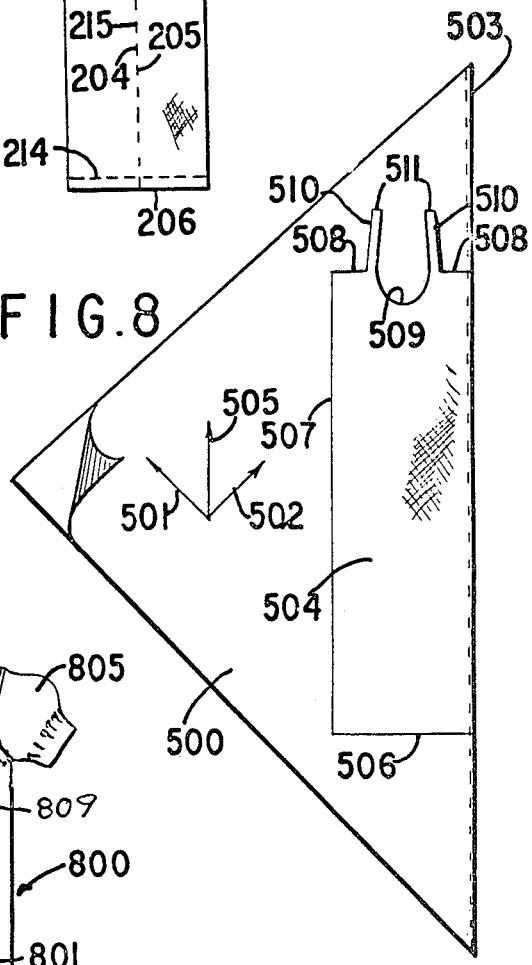
FIG. 8 is a front view of a folded piece of material with a garment laid out on it for cutting.

Referring to FIG. 8, arrows 501 and 502 show the direction of the warp and woof, respectively, of an essentially square piece of fabric 500 which has been folded over with edge 503 as the fold. Area 504 is a garment laid out on this fabric so that it will be cut on the bias indicated by the direction of arrow 505 and may be assembled from one piece of fabric. The garment defined by area 504 will have a bottom edge 506 and edge 507 will from the body seam. Edges 509 defines the arm openings in the finished garment and edge 508 defines a neck opening and portion 510 will form shoulder suspending means by the joining of edge 511, respectively. The entire fabric piece may also be laid out on an open, not folded, piece of fabric requiring additional cutting.

Figure 9:
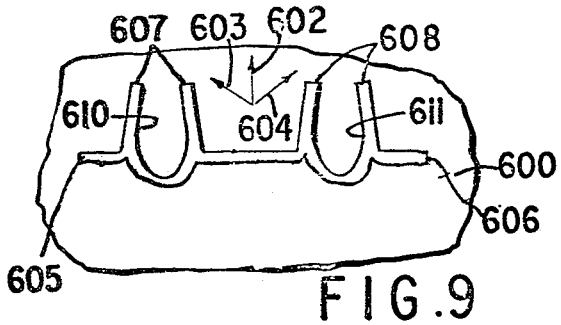
FIG. 9 is a front view of a section of a piece of material with a facing laid out prior to cutting.

Referring to FIG. 9, the piece of fabric 600 has facing 601 laid out on it and a bias represented by the direction of arrow 602 and the warp and woof represented, respectively, by the directions of arrows 603 and 604. After cutting out, the facing is assembled by joining edges 605 and 606 to form the body section and edges 607 and 608, respectively, to form shoulder straps which divide the formed head opening into a neck opening defined by edge 609 and arm openings defined by edges 610 and 611. The facing follows the edge of the garment with peaks under each arm. This shaping of the facing functions to provide easier, less restricted arm movement. This shaping could be omitted to provide a less movable garment.

Figure 10:
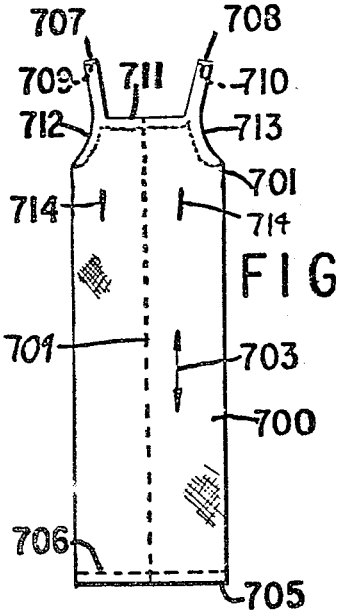
FIG. 10 is a front view of an assembled garment with a facing and seam seen through the garment.

Referring to FIG. 10, the completed garment has a tubular body member 700 convering facing 701 shaped for greater movement. The bias of body member and facing is defined by the direction of arrow 703. Edge 705 is the torso opening finished by hem 706. The body member is assembled by seam 704. The head opening is divided into arm openings defined by edges 712 and 713 and a neck opening defined by edge 711. The shoulder suspending means 707 and 708 which separate the arm and neck openings are assembled at seams 709 and 710, respectively. The body darts 714 may be used to take up material as an aid to providing a better fitting garment. One or more darts may be used, but two is the preferable number. The dart or darts are located to achieve the desired fit without distracting from the smooth lines of the garment.

Figure 11:
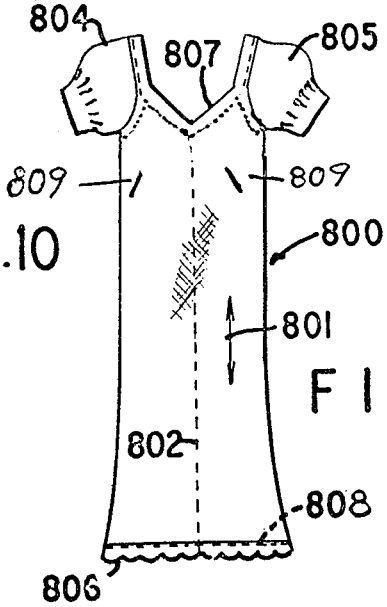
FIG. 11 is a front view of an assembled garment with a facing seen through the garment and a tapered decorated tubular body member and decorative sleeve.

Referring to FIG. 11, the completed garment 800 is assembled from one piece of fabric cut on the bias. The direction of the bias of the fabric is indicated by arrow 801. The garment is assembled with body seam 802. The neckline 807 of this garment is V-shaped. There is no limitation as to the type of neckline of the garments of this invention. For example, the necklines may be high or low, rounded or V-shaped or turtlenecked. The sleeves 804 and 805 are assembled conventionally and attached to the armholes, preferably by sewing, and are illustrative of the various types of sleeves which may be incorporated in this design. For example, the sleeves may be long or short, puffed, cap or bell shaped. The stitching 808 and ornamental scallop 806 at the bottom are illustrative of the various conventional ornamentation which may be used to embellish this design. The body member of this garment may also be tapered with the larger opening at the torso opening. The darts 809 provide a close fitting garment at the bust line.

In assembling the garments of the invention the preferable method is sewing. However, other methods such as gluing or interweaving may be used. The sewing to be used should be one which provides a flat unobtrusive appearance. The preferred method to be used in sewing the rear torso seam is the french seam, however, other seams could be used such as an overcast seam, double stitch seam, machine hemmed seam or the like. Furthermore, a rolled hem or overstitch may be used. The fabrics or materials to be used in the practice of this invention are those which lend themselves to conforming garments. Although woven fabrics are preferred, knit fabrics or materials may be used successfully.

The detailed description herein provided relating to the drawings, give exemplification of the invention which, however, is capable of expression other than as particularly described and illustrated without departing from the inventive concept.

What is claimed is:

1. A tubular torso conforming ladies garment having smooth lines made from a one-piece substantially rectangular bias cut piece of fabric, said piece of fabric including on one shorter side four substantially equal projections extending beyond the boundary line of the substantially rectangular shape, said projections being grouped into two pairs, each pair of which contains between them an indentation cut into the piece of fabric beyond the boundary line of the substantially rectangular shape; said piece of fabric being assembled into a tubular torso conforming ladies slip undergarment which substantially conforms to the shape of the feminine body from the area of the hips to the axilla when it is worn around the feminine body, said garment being constructed so that the bias of said single piece of fabric is substantially parallel to the axis of symmetry of said feminine body, said garment having shoulder suspending means, said garment having three assembly seams, the first being located on the torso portion of the garment parallel to the axis of symmetry of said feminine body, approximately centered on the rear torso portion of the garment, the second and third seams being located so that said shoulder suspending means are fastened together to form shoulder straps.

2. A garment as defined in claim 1 wherein the fabric is knit.

3. A garment as defined in claim 1 wherein the fabric is woven.

4. A garment as defined in claim 1 wherein said seam on the torso portion of the garment is completely sewn.

5. A garment as defined in claim 1 wherein said seam on the torso portion of the garment is joined by means which provide for opening and reclosing a portion of the seam.

6. A garment as defined in claim 1 wherein said seam on the torso portion of the garment is joined by means which provide for opening and reclosing the entire seam disassembling the torso portion of the garment when the seam is open.

7. A garment as defined in claim 1 wherein said torso portion contains one or more darts.

* * * * *